US005152085A

United States Patent [19]

Baggio et al.

[11] Patent Number: 5,152,085

[45] Date of Patent: Oct. 6, 1992

[54] REAR SUPPORTING DEVICE, PARTICULARLY IN SKI BOOTS

[75] Inventors: Giorgio Baggio, San Martino Di Lupari; Mariano Sartor; Giuseppe De Bortoli, both of Montebelluna; Luca Bugliesi, Piombino, all of Italy

[73] Assignee: Nordica S.p.A., Montebelluna, Italy

[21] Appl. No.: 639,450

[22] Filed: Jan. 10, 1991

[30] Foreign Application Priority Data

Jan. 15, 1990 [IT] Italy ..... 82503 A/90

[51] Int. Cl.[5] ..... A43B 5/04

[52] U.S. Cl. ..... 36/117; 36/120

[58] Field of Search ..... 36/117-121

[56] References Cited

U.S. PATENT DOCUMENTS

| | | | |
|---|---|---|---|
| 4,499,676 | 2/1985 | Chalmers, II | 36/117 X |
| 4,653,204 | 3/1987 | Morell et al. | 36/117 |
| 4,677,768 | 7/1987 | Benoit et al. | 36/117 |
| 4,918,842 | 4/1990 | Lederer | 36/117 |
| 5,020,248 | 6/1991 | Hercog et al. | 36/117 X |
| 5,036,005 | 8/1991 | Marega | 36/117 X |

FOREIGN PATENT DOCUMENTS

| | | | |
|---|---|---|---|
| 0213613 | 3/1987 | European Pat. Off. | 36/117 |
| 0229638 | 7/1987 | European Pat. Off. . | |
| 0342463 | 11/1989 | European Pat. Off. . | |
| 2807371 | 8/1979 | Fed. Rep. of Germany . | |
| 3506056 | 3/1986 | Fed. Rep. of Germany | 36/117 |
| 1475936 | 4/1967 | France . | |
| 2089128 | 1/1972 | France . | |
| 0181178 | 11/1981 | Italy . | |

*Primary Examiner*—Paul T. Sewell
*Assistant Examiner*—Ted Kavanaugh
*Attorney, Agent, or Firm*—Guido Modiano; Albert Josif

[57] ABSTRACT

A ski boot composed of at least one quarter, articulated to a shell, and having, at the rear region adjacent to its own upper perimetric edge, a seat for a flap. The device includes a eccentric lever which is preferably pivoted transversely to at least one pair of wings which protrude laterally to the quarter. The eccentric lever naturally interacts with the flap and allows it to keep at least two operative positions: an inclined one for skiing, when the lever is closed, and a rearward one for walking or for adapting to the calf of the skier's leg when the lever is open.

6 Claims, 3 Drawing Sheets

REAR SUPPORTING DEVICE, PARTICULARLY IN SKI BOOTS

BACKGROUND OF THE INVENTION

The present invention relates to an adjustable rear supporting device particularly usable in ski boots composed of at least one quarter articulated to a shell.

It has been always an important problem, that of providing a optimal support to the back of the skier's leg in ski boots.

A French patent, no. 1,475,936 filed on Feb. 23, 1966, for example, discloses a ski boot in which an attempt has been made to solve this problem, but it had the disadvantage that a variation in the rear support entailed an increase in the circumference of the upper perimetric edge of said boot with a consequent reduction in the degree of securing of the leg.

A German patent, DE 2807371 filed on Feb. 21, 1978, discloses a device for the adjustment of the quarter with respect to the shell of a ski boot which has an eccentric element with a point of rotation on the shell or on the quarter.

Even this device, which allows the adjustment of the inclination of the quarter, also has a disadvantage: in fact it pushes the quarter vertically from below, and said quarter must therefore be moved forward, flexing the leg, in order to be able to actuate the device.

Without this operation, the adjustment would occur under stress, consequently requiring the skier to exert considerable efforts and possibly leading to the breakage of the device.

An improvement to the device of the above mentioned patent was provided by the same Applicant in the Italian utility model, No. 181178 filed on May 23, 1980, which discloses a device for the adjustment of the inclination of the upper quarter which comprises an abutment block which is associated with the rear part of the shell of the boot and is suitable for engaging by contact with the upper quarter to define its inclination, the peculiarity consisting of the fact that the block and the abutment can be positioned at various vertical levels on the upper quarter to vary the inclination.

However, even this solution has the disadvantage of requiring the forward inclination of the upper quarter in order to allow the activation of the device without excessive efforts.

Furthermore, although these devices provided an adjustment of the inclination of the quarter, they do not solve the problem related to the particular configuration of the calf of the skier, which is not adequately supported at the rear region of the rear quarter.

As a partial solution to this disadvantage as well, the same Applicant filed an Italian utility model application, No. 20463 B/86, on Jan. 13, 1986, wherein an upper quarter is articulated transversely at the rear end of the rear quarter of a boot and its position, and therefore its inclination with respect to the quarter, is actuated by means of an adapted lever which is pivoted to the rear quarter and interacts ratchet-like with a toothed band associated with the upper quarter.

Though undoubtedly effective, this solution has the disadvantage of being difficult to industrialize, due both to the particular configuration of the upper quarter and to the need to subsequently assembly all the components onto the boot.

The solution is therefore productively expensive.

In order to try to overcome these problems, which are thus related to constructive complications and to production costs, the same Applicant filed a patent application, No. 82550 A/88, on May 20, 1988, which discloses several solutions adapted to adjust the position of an upper quarter or, in any case, of a flap located at the rear region: even these solutions, however, are structurally not very simple and entail excessive manufacturing costs, which increase the overall cost of the boot.

SUMMARY OF THE INVENTION

The aim of the present invention is therefore to eliminate the disadvantages described above in known types by providing a device which, when applied to a ski boot, allows to achieve an optimum adaptation thereof at the region of the skier's calf, though an optimum securing of the leg inside it is maintained.

Within the scope of the above described aim, another important object is to provide a device which allows the skier to walk easily if required, by letting the legs keep an upright position, though the quarter or quarters are closed.

Another important object is to provide a device which can be activated even under stress and without therefore requiring the execution of particular preliminary operations on the part of the skier.

Still another object is to obtain a device which associates with the preceding characteristics that of allowing the activation under stress to be achieved in a rapid and simple manner on the part of the skier.

Still another important object is to obtain a device which associates with the preceding characteristics that of being structurally simple and therefore equally simple to industrialize.

Not least object is to obtain a device which has low production costs.

The above described aim and objects, as well as others which will become apparent hereinafter, are achieved by a rear supporting device, particularly for ski boots composed of at least one quarter articulated to a shell, said quarter having, at the rear region adjacent to the upper perimetric edge, a recess which acts as seat for a flap, characterized in that it comprises an eccentric lever which is operatively associated with said at least one quarter and with said flap.

BRIEF DESCRIPTION OF THE DRAWINGS

Further characteristics and advantages of the invention will become apparent from the detailed description of some particular but not exclusive embodiments, illustrated only by way of non-limitative example in the accompanying drawings, wherein.

DESCRIPTION OF THE PREFERRED EMBODIMENTS

Figure 1:
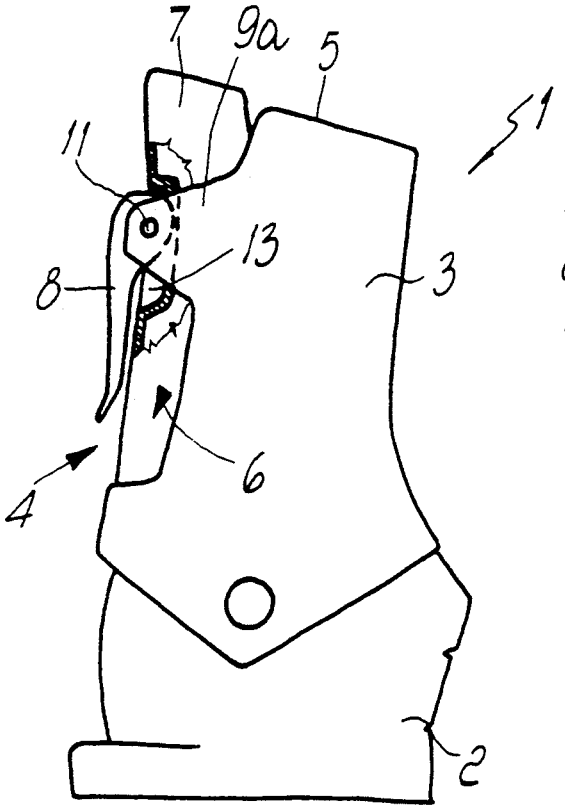
FIG. 1 is a side partial view of a ski boot according to the invention.
Figure 2:
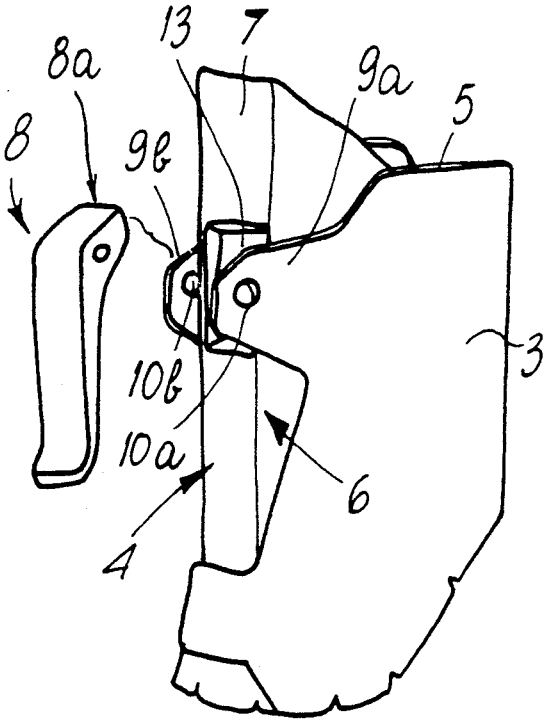
FIG. 2 is a rear perspective partial view of the ski boot of FIG. 1 wherein the lever is uncoupled from the quarter.
Figure 3:
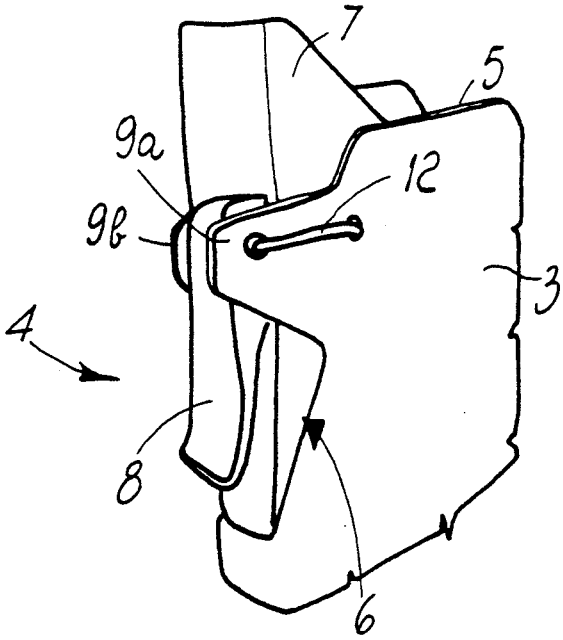
FIG. 3 is a rear perspective partial view of a ski boot according to a second aspect of the invention.

With reference to FIGS. 1–3, the reference numeral 1 indicates a ski boot composed of a shell 2 with which at least one quarter 3 is articulated.

Said quarter has, at the rear region 4, extending downwardly along its own longitudinal extension from to its own upper perimetric edge 5, a recess 6 which acts as seat for a flap 7 for supporting a user's lower leg region.

Said flap is associable with the quarter 3 or with the shell 2, for example by means of a temporary-permanent snug fitting or pivoting thereto, or obtained by molding from the shell itself, and thus the flap is movable between a supporting engagement position and a nonsupporting disengagement position.

The adjustable rear support device comprises an eccentric lever 8 which is pivoted to at least one pair of wings 9*a* and 9*b* which protrude laterally to the quarter 3, at the recess 6.

Said wings 9*a* and 9*b* laterally embrace the flap 7, and adapted holes 10*a* and 10*b* are provided at their free end for the pivoting of the eccentric lever 8 for example by means of a pivot 11.

As an alternative, illustrated in FIG. 3, the eccentric lever 8 can be connected to the quarter 3 by means of a traction element, such as for example a cable 12, which is laterally associated with the quarter 3 at its ends; preferably but not necessarily, the cable 12 is guided by the wings 9*a* and 9*b*.

Advantageously, the eccentric element or portion 8*a* of the lever 8 is accommodated at an adapted seat 13 defined in the rear region of the flap 7 which is adjacent to the wings 9*a* and 9*b*.

The use of the device is therefore as follows: when the lever is closed, a certain inclination with respect to the longitudinal axis of the quarter 3, preferably usable while skiing, is imparted to the flap 7 whereas, when the lever is open, the flap 7 is allowed to move backward or assume a different inclination with respect to the axis of the quarter 3 so as to allow walking or an adaptation to the anatomical configuration of the skier's calf.

When walking, the opening of the lever can for example allow the skier to keep the legs in an upright position, though the quarter or quarters of the boot are closed, thus avoiding tedious opening/closure operations, as well as possible slippages of the boot off the foot or the penetration of snow or mud inside the boot.

The fact is stressed that the actuation of the eccentric lever 8 imposes, by means of its eccentric portion 8*a*, a movement to the flap on the basis of a force which is imparted transversely to said flap, thus allowing to achieve an adjustment of its position even under stress.

In the previously described known art, instead, it was possible to impart to an upper quarter a movement along its own longitudinal axis which was difficult to perform under stress.

The device is furthermore structurally very simple as well as easy and rapid to industrialize and therefore economical.

It has thus been observed that the invention has achieved the intended aim and objects, an adjustable rear supporting device having been obtained which is extremely simplified from the constructive point of view and from the point of view of use, allowing the adaptation of the quarter to the various anatomical dimensions of the skier's calf or allowing the skier to walk easily though the quarter or quarters are closed.

The adjustment of the device can furthermore be obtained even under stress, the skier being able to easily actuate the eccentric lever 8 both for opening and for closure.

Finally, its constructive simplicity allows to achieve the execution of the device with very modest costs.

The ski boot according to the invention is naturally susceptible to numerous modifications and variations, all of which are within the scope of the same inventive concept.

Figure 5:
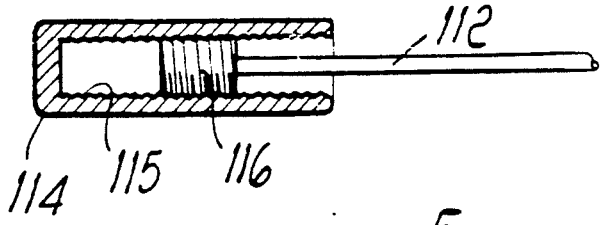
FIG. 5 is a side section view of a detail of the ski of FIG. 4.
Figure 4:
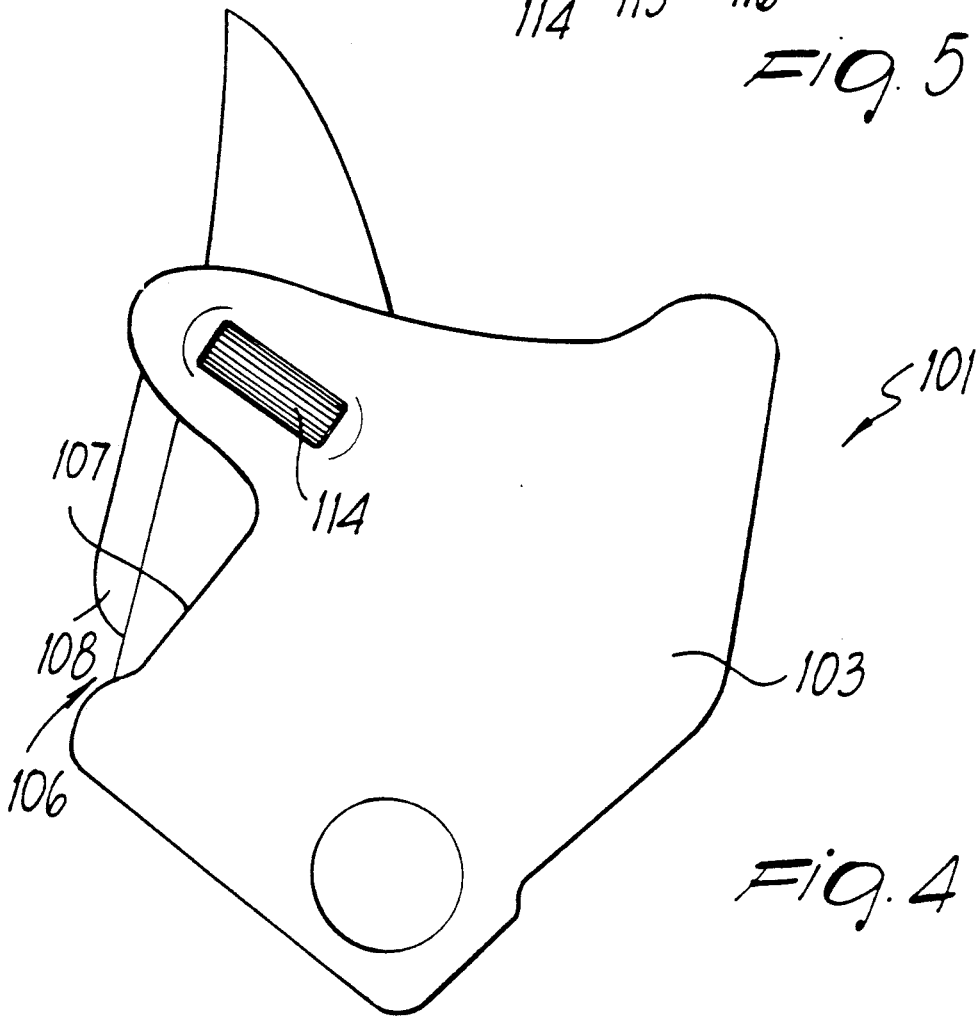
FIG. 4 is a side partial view of a ski boot according to a third aspect of the invention.
Figure 6:
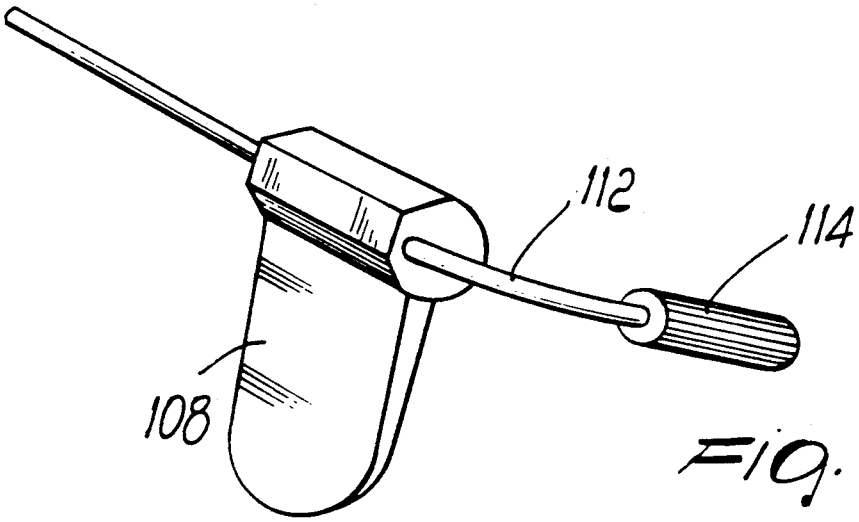
FIG. 6 is a schematic perspective view of the component parts of the device of the ski boot of FIGS. 4 and 5.

FIGS. 4–6, for example, illustrate a ski boot 101, of which only the quarter 103 is visible in FIG. 4, having a rear support device according to a second aspect of the invention. As in the previously described embodiment, a flap 107 is arranged at a recess 106 provided in the quarter 103.

An eccentric lever 108 is pivoted to the quarter 103 and acts on the flap 107 substantially as previously described. According to this second embodiment, a hollow knob 114 is rotatably associated with the quarter 103 and comprises an inner threading 115 engaging a nut 116.

The nut 116 is associated with the end of a cable 112 which is eccentrically guided in the lever 108 so that by operating the lever 108, the cable 112 is tensioned or released. As it is apparent, by turning the knob 114 the nut 116 is axially displaced, because it cannot rotate, thereby adjusting the working length of the cable 112.

Figure 7:
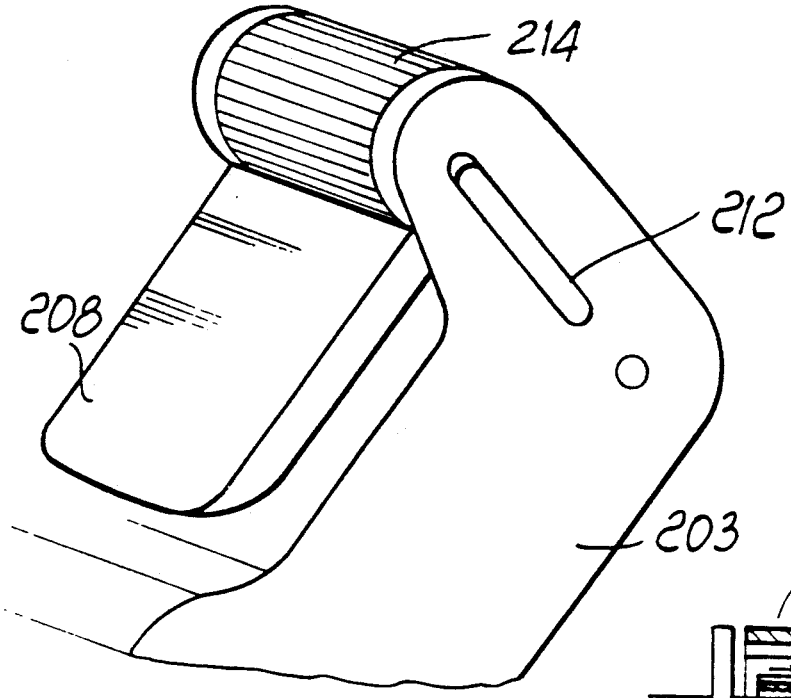
FIG. 7 is a partial rear perspective view of a ski boot according to a fourth aspect of the invention.
Figure 8:
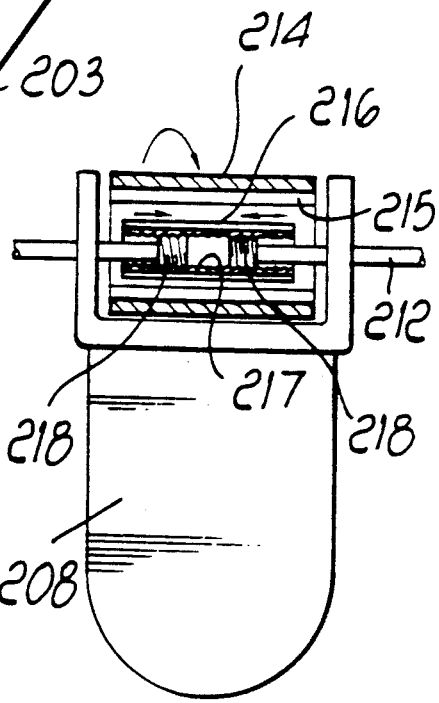
FIG. 8 is a rear section view of a detail of the boot of FIG. 7.
Figure 9:
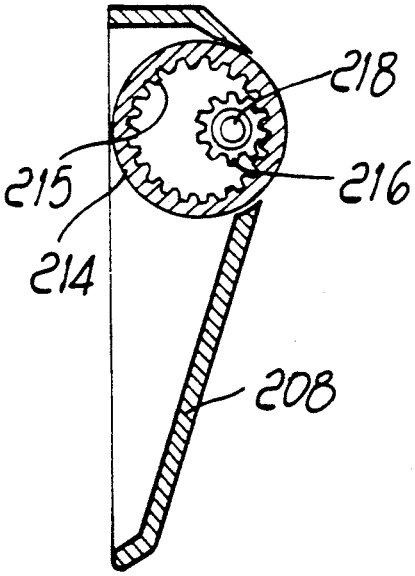
FIGS. 9 and 10 are side section views of respectively two different embodiments of the lever of the ski boot of FIGS. 7 and 8.

FIGS. 7–9 show a further embodiment of the invention wherein a lever 208 is pivoted to the quarter 203 and acts on a flap (not illustrated) as previously described. The lever 208 comprises a knob 214 for adjusting the working length of at least one cable 212. In this case too the knob 214 is hollow and comprises an inner toothing 215 engaging an inner gear wheel 216. The gear wheel 216 is hollow too and comprises two opposite threadings 217 engaging respective nuts 218. Each nut 218 is associated with a respective end of one of two cables 212. As it is apparent, by rotating the knob 214, the nuts 218 are brought close together or spaced apart, thereby adjusting the length of the cable (or cables) 212.

Figure 10:
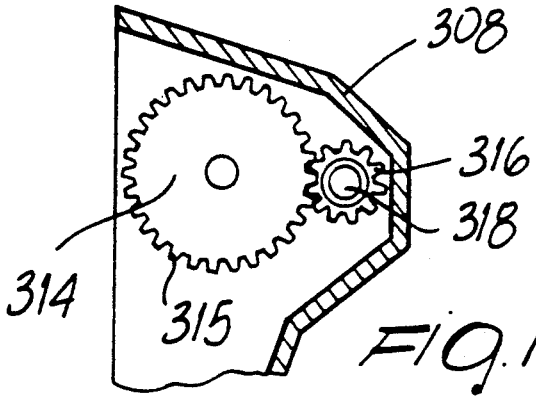

FIG. 10 shows a lever 308 in a ski boot according to a further aspect of the invention, wherein a knob 314 is arranged in the lever 308 and has an outer toothing 315 engaging an outer gear wheel 316. The gear wheel 316 is hollow and engages one or two bolts 318 for adjusting the working length of one or two cables (not illustrated) as previously described. The knob 314 has an outer portion (not illustrated in the drawings) in order to be actuated by the user.

The device can thus be also applied to ski boots composed of a front quarter and of a rear quarter.

The wings 9*a* and 9*b* can furthermore be obtained directly at the quarter or applied thereon.

The dimensions and the materials which constitute the 0 individual components of the device may naturally be the most appropriate according to the specific requirements.

We claim:

1. A rear supporting device, particularly for a ski boot which comprises at least one quarter articulated to said shell, said quarter having an upper perimetric edge and a longitudinal; extension, said quarter being provided with a recess, which constitutes a cutout portion of the rear edge of the quarter which extends downwardly from said upper perimetric edge along said longitudinal extension, said supporting device comprising a flap element for supporting a user's lower leg region, said flap element being pivotally mounted to said quarter and being arranged in said recess to completely span said cutout portion of said quarter thereby said flap element being pivotally movable between a supporting engagement position for supporting the user's level leg region and a nonsupporting disengagement position, said rear supporting device further comprising an eccentric lever pivoted to said quarter, said eccentric lever having an eccentric portion for engaging said flap element to move and maintain said flap element in said supporting engagement position.

2. Device according to claim 1, further comprising pivot means (11) for pivoting said eccentric lever to a pair of wings (*a*,9*b*) which are provided with holes (10*a*, 10*b*) for said pivot means and which rearwardly extend from said quarter (3).

3. A rear supporting device, particularly for a ski boot which comprises at least one quarter articulated to said shell, said quarter having an upper perimetric edge and a longitudinal extension, said quarter being provided with a recess, which constitutes a cutout portion of the rear edge of the quarter which extends downwardly from said upper perimetric edge along said longitudinal extension, said supporting device comprising a flap element for supporting a user's lower leg region, said flap element being pivotally mounted to said quarter and being arranged in said recess to completely span said cutout portion of said quarter thereby said flap element being pivotally movable between a supporting engagement position for supporting the user's lower leg region and a nonsupporting disengagement position, said rear supporting device further comprising an eccentric lever pivoted to said quarter, said eccentric lever having an eccentric portion for engaging said flap element to move and maintain said flap element in said supporting engagement position, said eccentric lever being pivotally mounted to said quarter by means of a cable element connected laterally to said quarter.

4. A rear supporting device, particularly for a ski boot which comprises at least one quarter articulated to said shell, said quarter having an upper perimetric edge and a longitudinal extension, said quarter being provided with a recess which constitutes a cutout portion of the rear edge of the quarter which extends downwardly from said upper perimetric edge along said longitudinal extension, said supporting device comprising a flap element for supporting a user's lower leg region, said flap element being pivotally mounted to said quarter and being arranged in said recess to completely span said cutout portion of said quarter thereby said flap element being pivotally movable between a supporting engagement position for supporting the user's lower leg region and a nonsupporting disengagement position, said rear supporting device further comprising an eccentric lever pivoted to said quarter, said eccentric lever having an eccentric portion for engaging said flap element to move and maintain said flap element in said supporting engagement position, said eccentric lever being pivotally mounted to said quarter by means of a cable element connected laterally to said quarter, said supporting device further comprising means for adjusting the working length of said cable element.

5. Device according to claim 4, wherein said means for adjusting the working length of said cable element comprise:

a hollow knob (114) which is rotatably connected to said quarter and which is provided with an inner thread (115); and an externally threaded nut (116) which is rigidly connected to said cable element and which is accommodated inside said hollow knob in threaded contact with said inner thread thereof.

6. Device according to claim 4, wherein said means for adjusting the working length of said cable element comprise:

a toothed knob (214,314) rotatably connected to said lever (208,308);

a hollow toothed gear wheel (216,316) rotatably supported by said lever which is internally threaded and which is in meshing contact with said toothed knob; and externally threaded nut elements threadingly accommodated in said hollow toothed gear wheel and rigidly connected to said cable element.

* * * * *